US010011122B2

(12) United States Patent
Mashima

(10) Patent No.: US 10,011,122 B2
(45) Date of Patent: Jul. 3, 2018

(54) PRINTING APPARATUS AND MEDIUM SUPPORT METHOD

(71) Applicant: SEIKO EPSON CORPORATION, Tokyo (JP)

(72) Inventor: Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/429,683

(22) Filed: Feb. 10, 2017

(65) Prior Publication Data

US 2017/0232764 A1 Aug. 17, 2017

(30) Foreign Application Priority Data

Feb. 12, 2016 (JP) ..... 2016-024502

(51) Int. Cl.

| | |
|---|---|
| ***B41J 3/407*** | (2006.01) |
| ***B41J 11/02*** | (2006.01) |
| ***B41J 11/14*** | (2006.01) |
| ***B41J 11/06*** | (2006.01) |

(52) U.S. Cl.

CPC ..... *B41J 3/4078* (2013.01); *B41J 11/02* (2013.01); *B41J 11/06* (2013.01); *B41J 11/14* (2013.01)

(58) Field of Classification Search

CPC ... B41J 11/58; B41J 11/02; B41J 11/14; B41J 3/4078

See application file for complete search history.

(56) References Cited

U.S. PATENT DOCUMENTS

2015/0283825 A1* 10/2015 Takai ..... B41J 3/4073 347/9

FOREIGN PATENT DOCUMENTS

JP 2005-096379 4/2005

* cited by examiner

*Primary Examiner* — Jason Uhlenhake
(74) *Attorney, Agent, or Firm* — Workman Nydegger

(57) ABSTRACT

Provided is a printing apparatus that includes a support unit which has a support surface for supporting a medium and moves in a movement direction, and a print unit configured to perform printing on the medium supported by the support unit. The support surface includes a first side and a second side that is shorter in length than the first side and extends in a direction intersecting with the first side. The support unit can be displaced to be in a first state where the first side is so arranged as to be along the movement direction and in a second state where the first side is so arranged as to be along a direction intersecting with the movement direction.

5 Claims, 10 Drawing Sheets

PRINTING APPARATUS AND MEDIUM SUPPORT METHOD

BACKGROUND

1. Technical Field

The present invention relates to printing apparatuses and medium support methods.

2. Related Art

Various types of printing apparatuses have been used. Among them, such printing apparatuses that include a movable support unit configured to support a medium on a support surface thereof having a long side and a short side, have been used.

For Example, JP-A-2005-96379 discloses a printing apparatus (ink jet printer) that includes a platen longer in size in a movement direction of the platen and shorter in size in a direction intersecting with the movement direction thereof, and is capable of moving the platen so as to slant the platen relative to the horizontal plane (slant the support surface).

SUMMARY

Printing is performed on media of various outer shapes (various kinds of clothes, vertically long bags, horizontally long bags, and so on) these days. Because of this, printing apparatuses including a movable support unit configured to support a medium on a support surface thereof having a long side and a short side, are required to be capable of changing a setting direction of the medium. However, the printing apparatus disclosed in JP-A-2005-96379 is constituted to be capable of merely slanting the support surface, but not capable of changing the setting direction of the medium with respect to the support unit in accordance with the outer shape of the medium.

An advantage of some aspects of the invention is to make it possible to change a setting direction of a medium with respect to a support unit in accordance with an outer shape of the medium.

In order to solve the above issue, a printing apparatus according to a first aspect of the invention includes a support unit which has a support surface for supporting a medium and moves in a movement direction, and a print unit configured to perform printing on the medium supported by the support unit. The support surface includes a first side and a second side that is shorter in length than the first side and extends in a direction intersecting with the first side. The support unit can be displaced to be in a first state where the first side is so arranged as to be along the movement direction and a second state where the first side is so arranged as to be along a direction intersecting with the movement direction.

According to this aspect, the support unit can be displaced to be in the first state where the first side is so arranged as to be along the movement direction and in the second state where the first side is so arranged as to be along a direction intersecting with the movement direction. In other words, the orientation of the support surface having the long and short sides can be changed. This makes it possible to change the setting direction of a medium with respect to the support unit in accordance with the outer shape of the medium.

A printing apparatus according to a second aspect of the invention is such that the printing apparatus of the first aspect further includes a base unit capable of attaching/detaching the support unit, a first engagement unit configured to engage the support unit and the base unit with each other when the support unit is set to the first state, and a second engagement unit configured to engage the support unit and the base unit with each other when the support unit is set to the second state.

According to this aspect, included are the base unit capable of attaching/detaching the support unit, the first engagement unit configured to engage the support unit and the base unit with each other when the support unit is set to the first state, and the second engagement unit configured to engage the support unit and the base unit with each other when the support unit is set to the second state. In other words, the orientation of the support unit with respect to the base unit can be changed (selected) depending on which of the first engagement unit and the second engagement unit engages the base unit when the base unit supports the support unit. As such, because the setting direction of the medium can be changed only by detaching the support unit from the base unit, changing the orientation thereof, and attaching it again to the base unit, the setting direction of the medium with respect to the support unit can be changed in accordance with the outer shape of the medium in a simple structure without providing any special mobile mechanism or the like.

A printing apparatus according to a third aspect of the invention is such that the printing apparatus of the first aspect further includes a base unit capable of attaching/detaching the support unit, and the support unit can be displaced to be in the first state and the second state by being revolved relative to the base unit.

According to this aspect, the support unit can be displaced to be in the first state and the second state by being revolved relative to the base unit. With this, the setting direction of the medium with respect to the support unit can be easily changed in accordance with the outer shape of the medium without detaching the support unit from the base unit even in the case where the support unit is heavy or the like, for example.

A printing apparatus according to a fourth aspect of the invention is such that the printing apparatus of any one of the first to third aspects further includes a fixing portion configured to fix the support unit in at least one of the first state and the second state.

According to this aspect, provided is the fixing portion configured to fix the support unit in at least one of the first state and the second state. This makes it possible to suppress degradation in print quality or the like due to the support unit being shifted relative to the base unit.

A medium support method according to a fifth aspect of the invention is a medium support method in a printing apparatus that includes a support unit which has a support surface for supporting a medium and moves in a movement direction and a print unit which performs printing on the medium supported by the support unit, where the support surface includes a first side and a second side which is shorter in length than the first side and extends in a direction intersecting with the first side; the method includes displacing the support unit, in accordance with an outer shape of the medium, to be in a first state where the first side is so arranged as to be along the movement direction and a second state where the first side is so arranged as to be along a direction intersecting with the movement direction.

According to this aspect, the support unit is displaced, in accordance with the outer shape of the medium, to be in the first state where the first side is so arranged as to be along the movement direction and the second state where the first side is so arranged as to be along a direction intersecting with the movement direction. In other words, the orientation of the support surface having the long and short sides can be changed. This makes it possible to change the setting direction of the medium with respect to the support unit in accordance with the outer shape of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an embodiment of the invention will be described in detail with reference to the accompanying drawings.

First Embodiment (FIGS. 1 to 8B)

Figure 1:
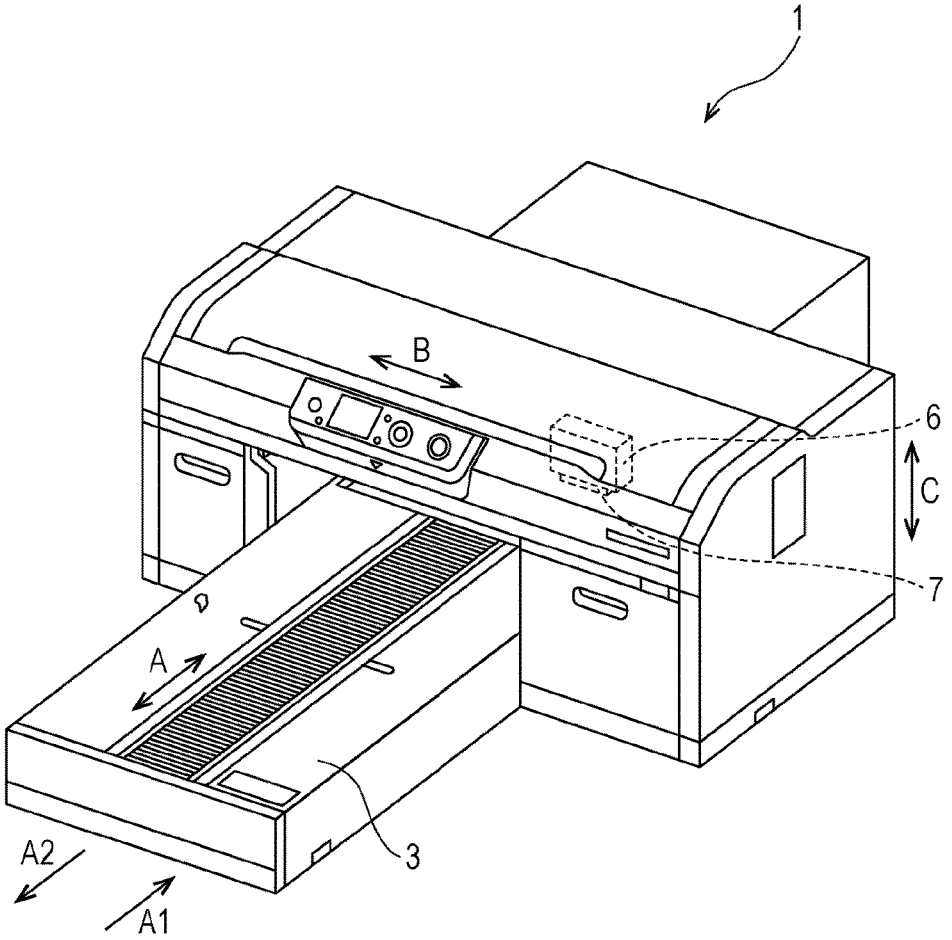
FIG. 1 is a schematic perspective view illustrating a printing apparatus according to a first embodiment of the invention.
Figure 2:
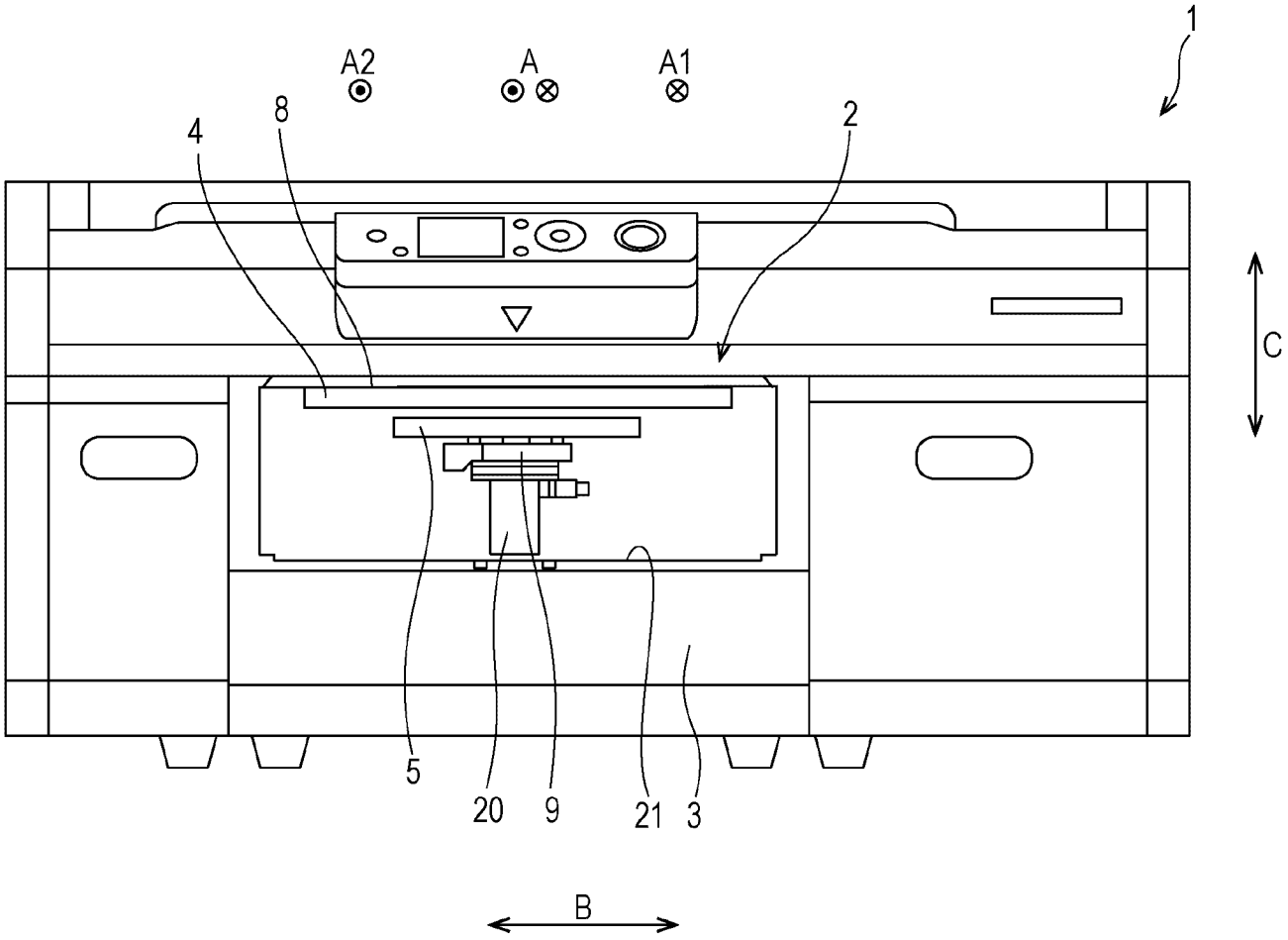
FIG. 2 is a schematic front view illustrating the printing apparatus according to the first embodiment of the invention.
Figure 3:
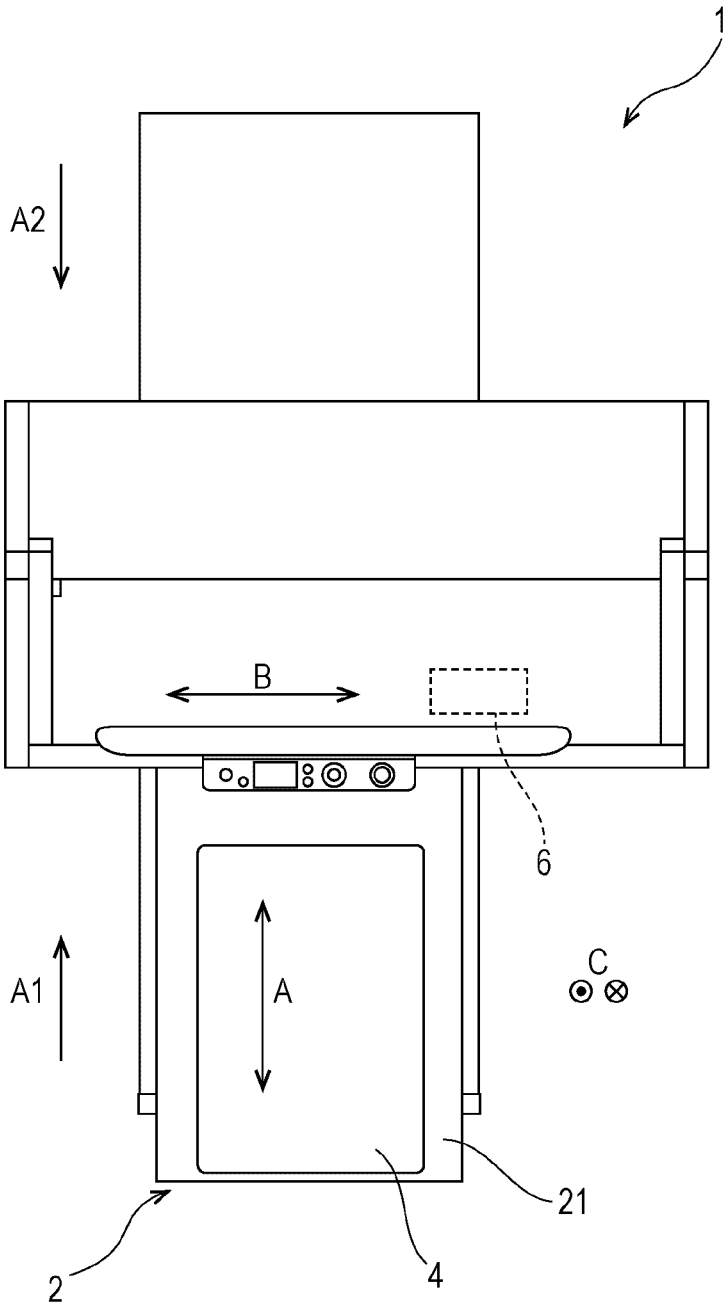
FIG. 3 is a schematic plan view illustrating the printing apparatus according to the first embodiment of the invention.
Figure 4:
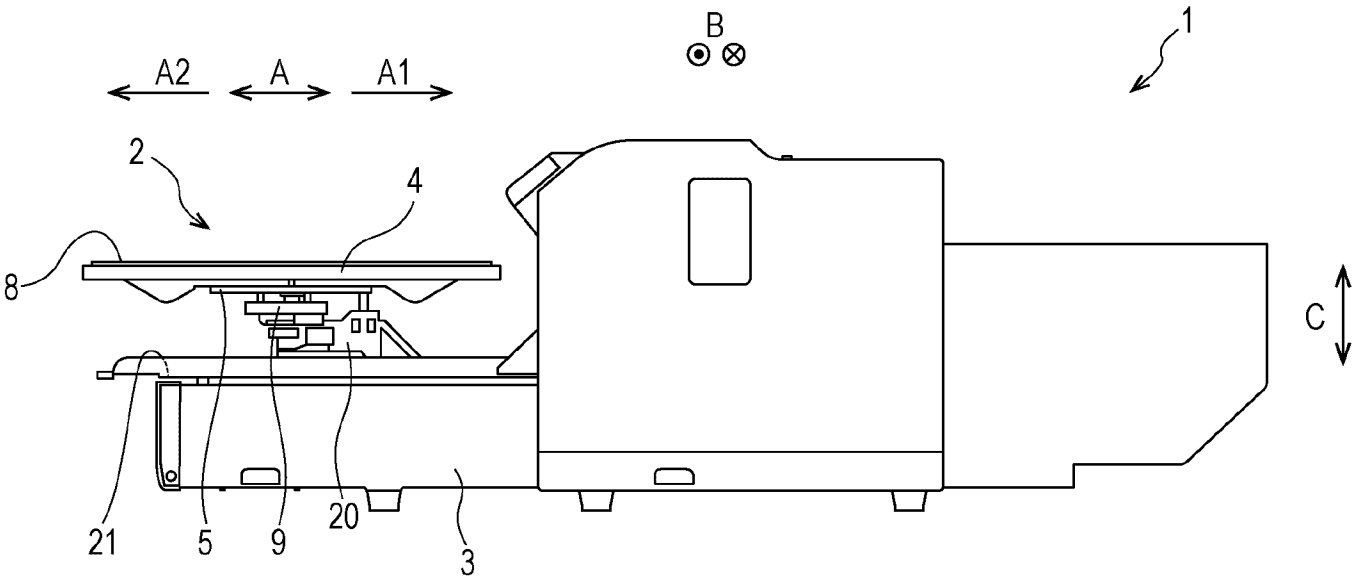
FIG. 4 is a schematic side view illustrating the printing apparatus according to the first embodiment of the invention.

FIG. 1 is a schematic perspective view of the printing apparatus 1 according to a first embodiment, and illustrates a state where a medium support unit 2 is set at a print starting position. FIG. 2 is a schematic front view of the printing apparatus 1 of the embodiment. FIG. 3 is a schematic plan view of the printing apparatus 1 of the embodiment, and FIG. 4 is a schematic side view of the printing apparatus 1 of the embodiment. Each of FIGS. 3 and 4 illustrates a state where the medium support unit 2 is set at a position for setting a medium M (see FIG. 5).

The printing apparatus 1 of the embodiment includes the medium support unit 2 that moves in a movement direction A while supporting the medium M on a support surface 8 of a tray 4. The medium support unit 2 includes the tray 4 serving as a support unit of the medium M. The printing apparatus 1 includes a medium transport unit 3 configured to transport the medium M supported by the tray 4 in the movement direction A. The movement direction A is a direction having a direction A1 and a direction A2 which is opposite to the direction A1. The tray 4 is set, in an attachable/detachable manner, on a stage 5 serving as a base unit. Here, an attaching/detaching direction C of the tray 4 with respect to the stage 5 is a vertical direction in the printing apparatus 1 of this embodiment. The tray 4 is moved, along with the stage 5, in a direction along the attaching/detaching direction C (vertical direction) by rotating a lever 9. As shown in FIGS. 2 and 4, the lever 9 is provided in an arm portion 20 of the medium support unit 2. Further, a medium reception portion 21 to receive the medium M stretching out from the tray 4 is provided under the tray 4 in the medium support unit 2.

Various types of materials such as textiles (fabrics, clothes, or the like), paper, vinyl chloride resin, and so on can be used as the medium M.

Further, a print head 7 capable of ejecting ink so as to perform printing on the medium M is provided inside a main body of the printing apparatus 1. Then, in the printing apparatus 1 of the embodiment, a carriage 6 in which the print head 7 is provided is moved back and forth in a scanning direction B which intersects with the movement direction A, whereby a desired image is formed by ejecting ink from the print head 7 onto the medium M supported by the tray 4 while moving the print head 7 back and forth in the scanning direction B.

The front side (lower left direction) of the printing apparatus 1 of this embodiment shown in FIG. 1 is a position for setting the medium M on the tray 4 (see FIGS. 3 and 4). Then, the tray 4, on which the medium M is set, is moved to the print starting position on the depth side (upper right direction) of FIG. 1 in the direction A1 of the movement direction A, and thereafter printing is performed while moving the tray 4 in the direction A2 of the movement direction A.

Although the printing apparatus 1 of this embodiment includes the print head 7 configured to print while moving back and forth in the scanning direction B, a printing apparatus including what is called a line head in which a plurality of nozzles for ejecting ink are provided in an intersection direction intersecting with the movement direction of the medium M may be employed.

Here, "line head" refers to a print head used in a printing apparatus, where a nozzle region formed in the intersection direction intersecting with the movement direction of the medium M is so provided as to be capable of covering the overall area in the intersection direction, and an image is formed by relatively moving the print head or the medium M. It may not be necessary that the nozzle region formed in the intersection direction of the line head be capable of covering the intersection direction of every medium that the printing apparatus supports.

Although the print head 7 of the embodiment is a print unit capable of printing by ejecting ink onto the medium M, the invention is not limited to the above print unit; a transfer-type print unit configured to print by transferring color materials to the medium may be employed, for example.

Figure 8B:
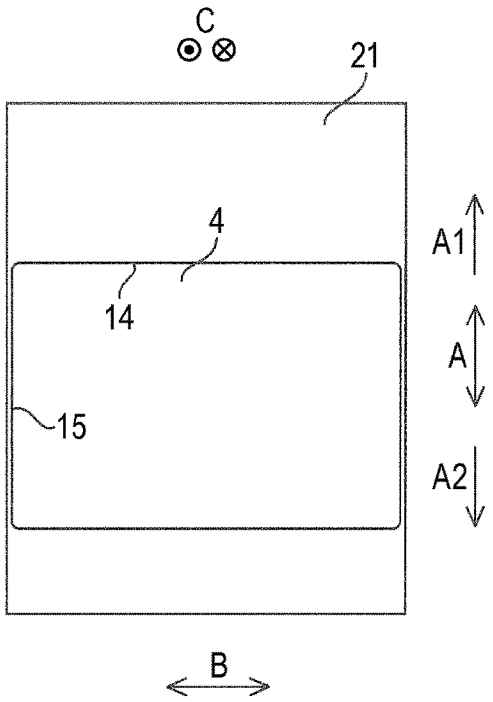
FIG. 8B is also a schematic plan view illustrating a principal portion of the printing apparatus according to the first embodiment of the invention.
Figure 8A:
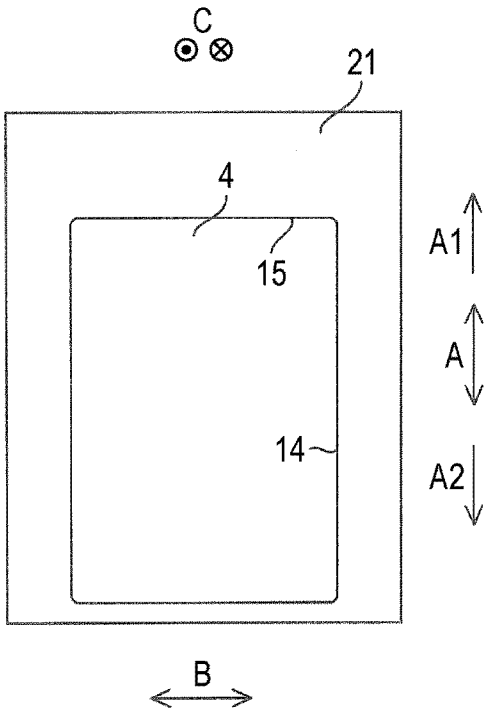
FIG. 8A is a schematic plan view illustrating a principal portion of the printing apparatus according to the first embodiment of the invention.

In the printing apparatus 1 of the embodiment, the rectangular tray 4 can be set on the stage 5 so that a long side 14 (see FIG. 5, FIG. 6, and FIGS. 8A and 8B) is arranged in a direction along the movement direction A of the medium support unit 2 and a direction along the scanning direction B (see FIGS. 8A and 8B). Note that, however, FIGS. 2 to 4 illustrate a case where the tray 4 is set so that the long side 14 is arranged in the direction along the movement direction A of the medium support unit 2.

Next, a principal portion of the printing apparatus 1 of this embodiment will be described below.

Figure 5:
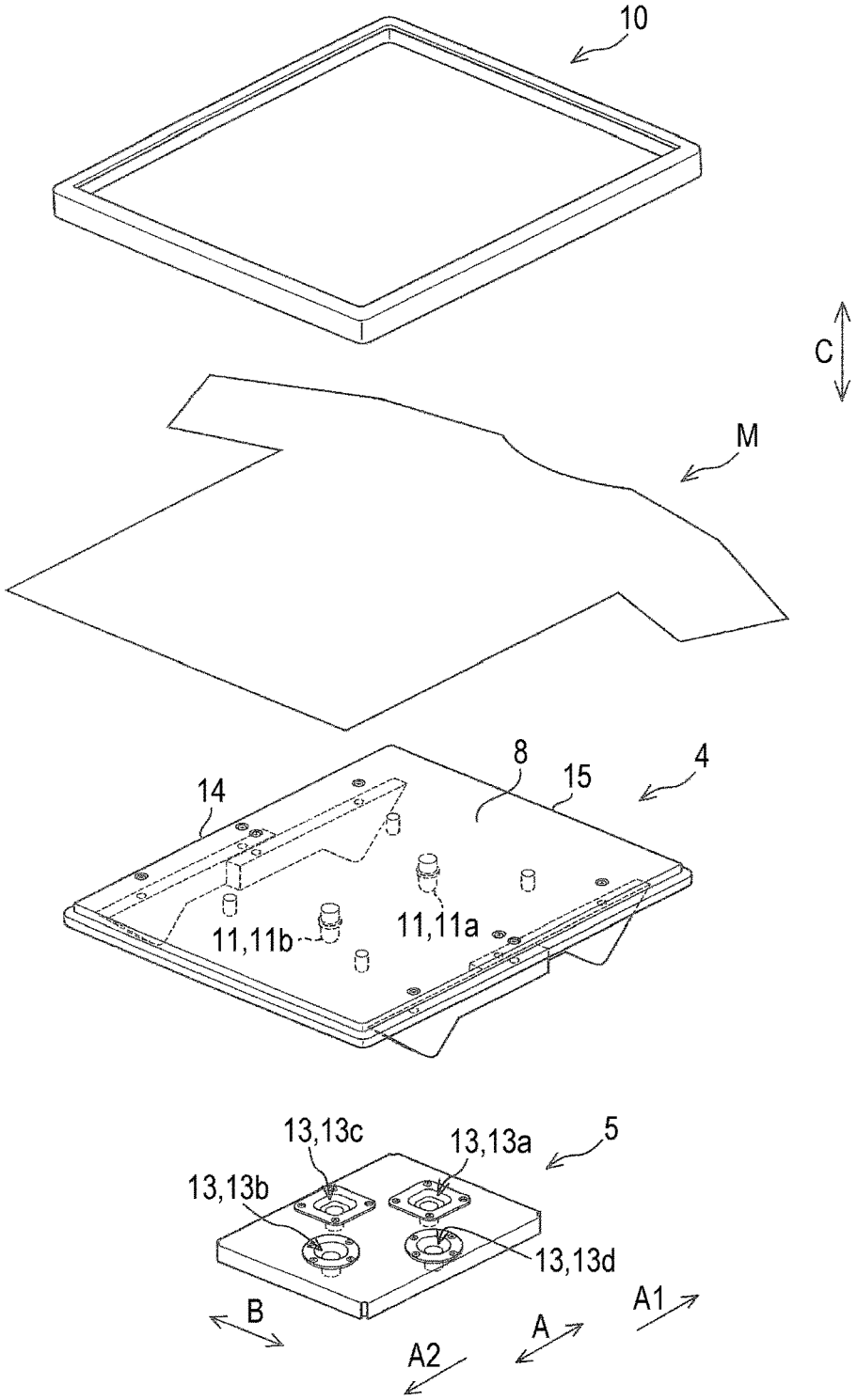
FIG. 5 is a schematic perspective view illustrating a principal portion of the printing apparatus according to the first embodiment of the invention.
Figure 6:
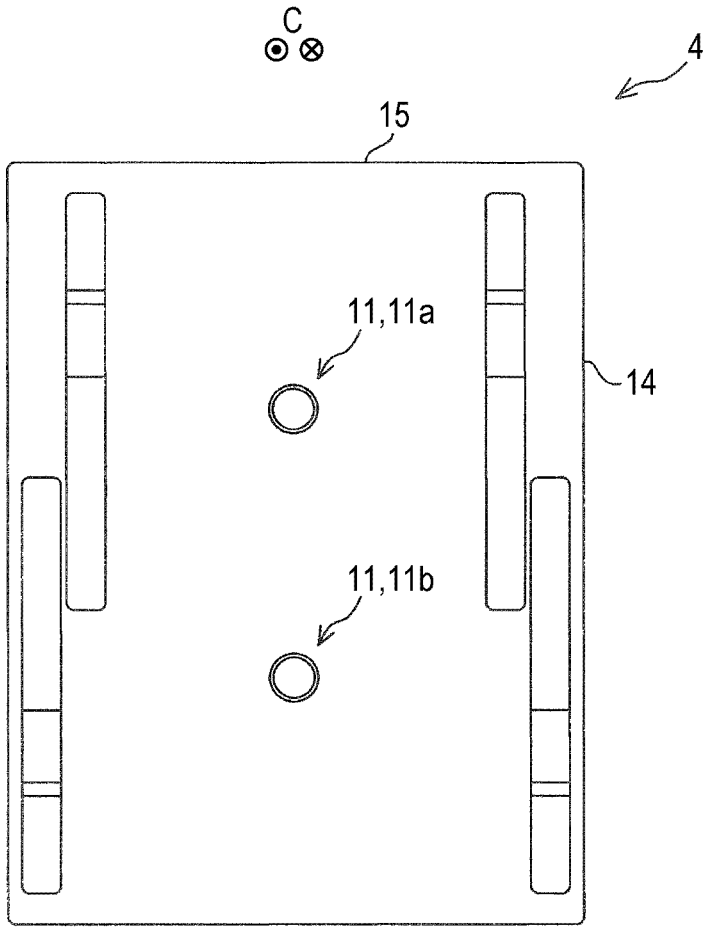
FIG. 6 is a schematic bottom view illustrating a principal portion of the printing apparatus according to the first embodiment of the invention.
Figure 7:
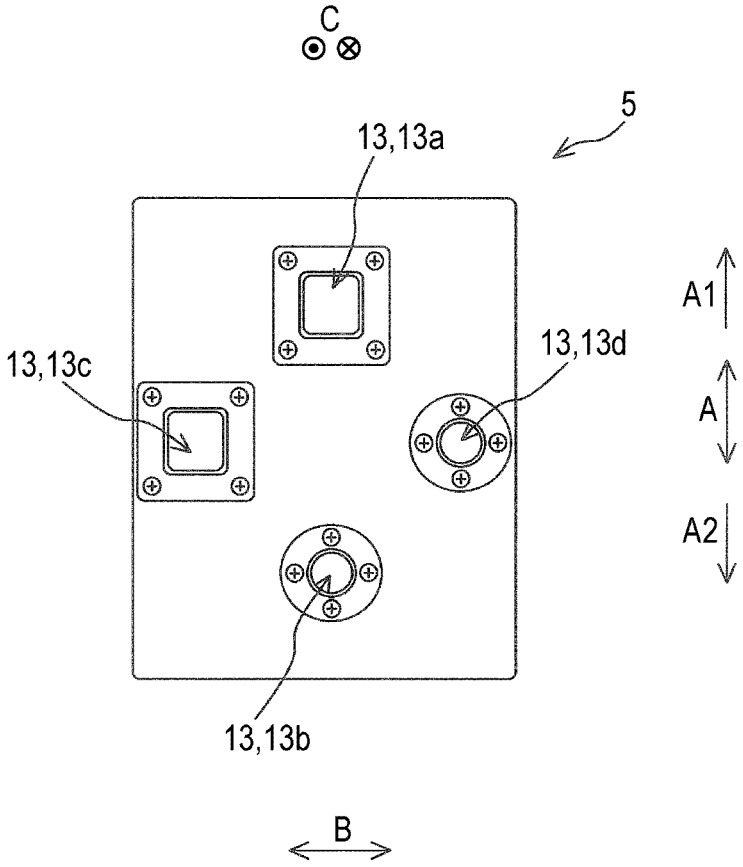
FIG. 7 is a schematic plan view illustrating a principal portion of the printing apparatus according to the first embodiment of the invention.

FIG. 5 is a schematic perspective view illustrating the tray 4, the stage 5, and so on constituting the medium support unit 2 as a principal portion of the printing apparatus 1 of the embodiment. Further, FIG. 6 is a schematic bottom view of the tray 4 as a principal portion of the printing apparatus 1 of the embodiment. FIG. 7 is a schematic plan view of the stage 5 as a principal portion of the printing apparatus 1 of the embodiment. Each of FIGS. 8A and 8B is a schematic plan view illustrating a state where the tray 4 is set on the stage 5; of FIGS. 8A and 8B, FIG. 8A illustrates a state where the tray 4 is set so that the long side 14 of the tray 4 is arranged in a direction along the movement direction A, and FIG. 8B illustrates a state where the long side 14 of the tray 4 is arranged in a direction along the scanning direction B.

As shown in FIG. 5, the medium support unit 2 of the embodiment is constituted such that the medium M is positioned and fixed on the support surface 8 of the tray 4 by making the support surface 8 of the tray 4 support the medium M and fitting a frame 10 onto the tray 4 supporting the medium M.

Further, as shown in FIGS. 5 and 6, inserting portions 11 (inserting portions 11*a* and 11*b*) are formed on the bottom surface side of the tray 4. Meanwhile, as shown in FIGS. 5 and 7, there are formed insertion openings 13 (insertion openings 13*a*, 13*b*, 13*c*, and 13*d*) in the stage 5 into which the inserting portions 11 can be inserted, and which are so constituted as to be capable of attaching/detaching the tray 4 along the attaching/detaching direction C. To be specific, in the case where the tray 4 is set so that the long side 14 of the tray 4 is arranged in a direction along the movement direction A, as shown in FIG. 8A, the insertion opening 13*a* corresponds to one of the inserting portions 11*a* and 11*b*, and the insertion opening 13*b* corresponds to the other one of the inserting portions 11*a* and 11*b*. In the case where the tray 4 is set so that the long side 14 of the tray 4 is arranged in a direction along the scanning direction B, as shown in FIG. 8B, the insertion opening 13*c* corresponds to one of the inserting portions 11*a* and 11*b*, and the insertion opening 13*d* corresponds to the other one of the inserting portions 11*a* and 11*b*.

As discussed above, the printing apparatus 1 of this embodiment includes the tray 4 that has the support surface 8 for supporting the medium M and moves in the movement direction A, and the print head 7 as a print unit configured to print on the medium M supported by the tray 4. Further, the support surface 8 includes the long side 14 as a first side, and a short side 15 as a second side being shorter in length than the long side 14 and extending in a direction intersecting with the long side 14.

Further, the tray 4 can be displaced to be in the first state (see FIG. 8A) where the long side 14 is so arranged as to be along the movement direction A and in the second state (see FIG. 8B) where the long side 14 is so arranged as to be along a direction intersecting with the movement direction A (along the scanning direction B). In other words, the printing apparatus 1 of the embodiment is constituted so that the orientation of the support surface 8 having the long side 14 and the short side 15 can be changed, and so that the setting direction of the medium M with respect to the tray 4 can be changed in accordance with the outer shape of the medium M.

To rephrase the above description, a medium support method of this embodiment is a medium support method in the printing apparatus 1 that includes the tray 4 which has the support surface 8 for supporting the medium M and moves in the movement direction A and the print head 7 which performs printing on the medium M supported by the tray 4, where the support surface 8 includes the long side 14 and the short side 15 which is shorter in length than the long side 14 and extends in a direction intersecting with the long side 14. The stated method includes displacing the tray 4, in accordance with the outer shape of the medium M, to be in the first state (see FIG. 8A) where the long side 14 is so arranged as to be along the movement direction A and the second state (see FIG. 8B) where the long side 14 is so arranged as to be along a direction intersecting with the movement direction A. According to the medium support method of the embodiment, the orientation of the support surface 8 having the long side 14 and the short side 15 can be changed so that the setting direction of the medium M with respect to the tray 4 can be changed in accordance with the outer shape of the medium M.

To rephrase the above description in another way, the printing apparatus 1 of the embodiment includes the tray 4 which has the support surface 8 for supporting the medium M and moves in the movement direction A, and the print head 7 as the print unit configured to perform printing on the medium M supported by the tray 4; the tray 4 is constituted such that widths (lengths) of the sides in two directions (for example, the movement direction A and the scanning direction B) which intersect with the supporting direction (attaching/detaching direction C) of the medium M and also intersect with each other are mutually different, and the tray 4 can be displaced to be arranged in a direction intersecting with the supporting direction of the medium M. With this constitution, the setting direction of the medium M with respect to the tray 4 can be changed in accordance with the outer shape of the medium M.

Further, as discussed above, the printing apparatus 1 of the embodiment includes the stage 5 capable of attaching/detaching the tray 4. In the case where the tray 4 is set to the first state by engaging the tray 4 and the stage 5 with each other, one of the inserting portions 11*a* and 11*b* is inserted into the insertion opening 13*a*, and the other one of the inserting portions 11*a* and 11*b* is inserted into the insertion opening 13*b*. Meanwhile, in the case where the tray 4 is set to the second state by engaging the tray 4 and the stage 5 with each other, one of the inserting portions 11*a* and 11*b* is inserted into the insertion opening 13*c*, and the other one of the inserting portions 11*a* and 11*b* is inserted into the insertion opening 13*d*.

To rephrase, the printing apparatus 1 includes the insertion openings 13*a* and 13*b* serving as a first engagement unit for engaging the tray 4 and the stage 5 when the tray 4 is set to the first state, and the insertion openings 13*c* and 13*d* serving as a second engagement unit for engaging the tray 4 and the stage 5 when the tray 4 is set to the second state.

The printing apparatus 1 of the embodiment, with the constitution as discussed above, is capable of changing (selecting) the orientation of the tray 4 with respect to the stage 5 depending on which of the first engagement unit and the second engagement unit engages the tray 4 and the stage 5 when the stage 5 supports the tray 4. As such, because the setting direction of the medium M can be changed only by detaching the tray 4 from the stage 5, changing the orientation thereof, and attaching it again to the stage 5, the setting direction of the medium M with respect to the tray 4 can be changed in accordance with the outer shape of the medium M in a simple structure without providing any special mobile mechanism or the like.

Figure 9:
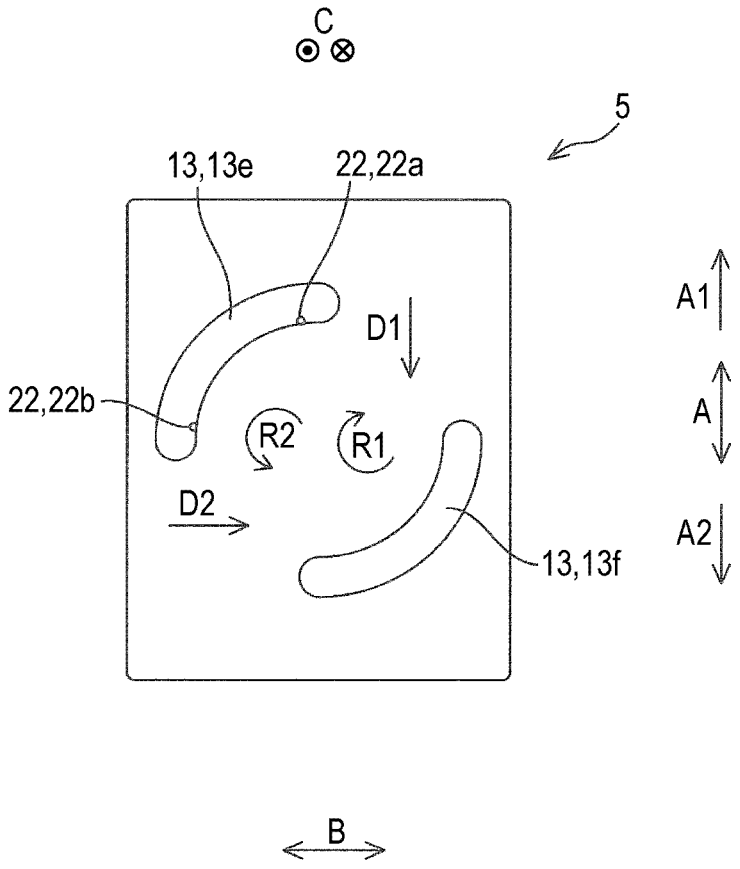
FIG. 9 is a schematic plan view illustrating a principal portion of a printing apparatus according to a second embodiment of the invention.

Second Embodiment (FIG. 9)

Next, a printing apparatus 1 according to a second embodiment will be described in detail with reference to the accompanying drawings.

FIG. 9 illustrates a schematic plan view of a stage 5 as a principal portion of the printing apparatus 1 of the second embodiment, and corresponds to FIG. 7 of the printing apparatus 1 of the first embodiment.

The printing apparatus 1 of the second embodiment has the same constitution as the printing apparatus 1 of the first embodiment except for the constitution of the stage 5.

The printing apparatus 1 of the first embodiment is constituted such that the tray 4 is detached from the stage 5, the orientation thereof is changed, and the tray 4 is attached again to the stage 5 when the setting direction of the tray 4 with respect to the stage 5 is changed.

In contrast, the printing apparatus 1 of the second embodiment is constituted such that the tray 4 is rotationally moved (revolved) relative to the stage 5 in a state in which the tray 4 is being attached to the stage 5 when the setting direction of the tray 4 with respect to the stage 5 is changed.

As shown in FIG. 9, arc-shaped hole portions 13*e* and 13*f* serving as insertion openings 13 are provided in the stage 5 of the embodiment. Here, the hole portion 13*e* is the insertion opening 13 into which one of the inserting portions 11*a* and 11*b* is inserted, and the hole portion 13*f* is the insertion opening 13 into which the other one of the inserting portions 11*a* and 11*b* is inserted. For example, in the case where the inserting portion 11*a* is inserted into the hole portion 13*e* and the inserting portion 11*b* is inserted into the hole portion 13*f*, and the tray 4 is revolved in a revolving direction R1 relative to the stage 5, the tray 4 is set to the first state where the long side 14 is so arranged as to be along the movement direction A (see FIG. 8A); if the tray 4 is revolved in a revolving direction R2 relative to the stage 5, the tray 4 is set to the second state where the long side 14 is so arranged as to be along the scanning direction B (see FIG. 8B).

In other words, the printing apparatus 1 of the embodiment includes the stage 5 capable of attaching/detaching the tray 4, and the tray 4 can be displaced to be in the first state and the second state by revolving relative to the stage 5. With this, the printing apparatus 1 of the embodiment is constituted so that the setting direction of the medium M with respect to the tray 4 can be easily changed in accordance with the outer shape of the medium M without detaching the tray 4 from the stage 5 even in the case where the tray 4 is heavy and so on, for example.

In order to fix the tray 4 onto the stage 5 in the first state, the hole portion 13*e* includes a projection 22*a* that can be pushed in a push-in direction D1. The hole portion 13*e* further includes a projection 22*b* that can be pushed in a push-in direction D2 in order to fix the tray 4 onto the stage 5 in the second state. Note that a push-out force is applied by an elastic member to the projection 22*a* of the embodiment in the opposite direction to the push-in direction D1, and a push-out force is applied to the projection 22*b* of the embodiment by an elastic member in the opposite direction to the push-in direction D2. Then, when an operator applies a force to the tray 4 in the revolving direction R1 or R2 to revolve the tray 4 relative to the stage 5 so that the inserting portion 11*a* or 11*b* passes through a region where the projections 22*a* and 22*b* are provided in the insertion opening 13, the projections 22*a* and 22*b* are pushed in and pushed out with respect to the insertion opening 13. Note that in the printing apparatus 1, only one of the projections 22*a* and 22*b* may be provided, or none of them may be provided.

In other words, the printing apparatus 1 of the embodiment includes fixing portions 22 (projections 22*a* and 22*b*) configured to fix the tray 4 in at least one of the first state and the second state. This makes it possible for the printing apparatus 1 of the embodiment to suppress degradation in the print quality due to the tray 4 being shifted in the revolving direction R1 or R2 relative to the stage 5, or the like.

Note that the constitution of the fixing portion 22 is not limited to any specific one. Hereinafter, a printing apparatus 1 according to a third embodiment including a different fixing portion 22 will be described in detail with reference to the accompanying drawings.

Figure 10:
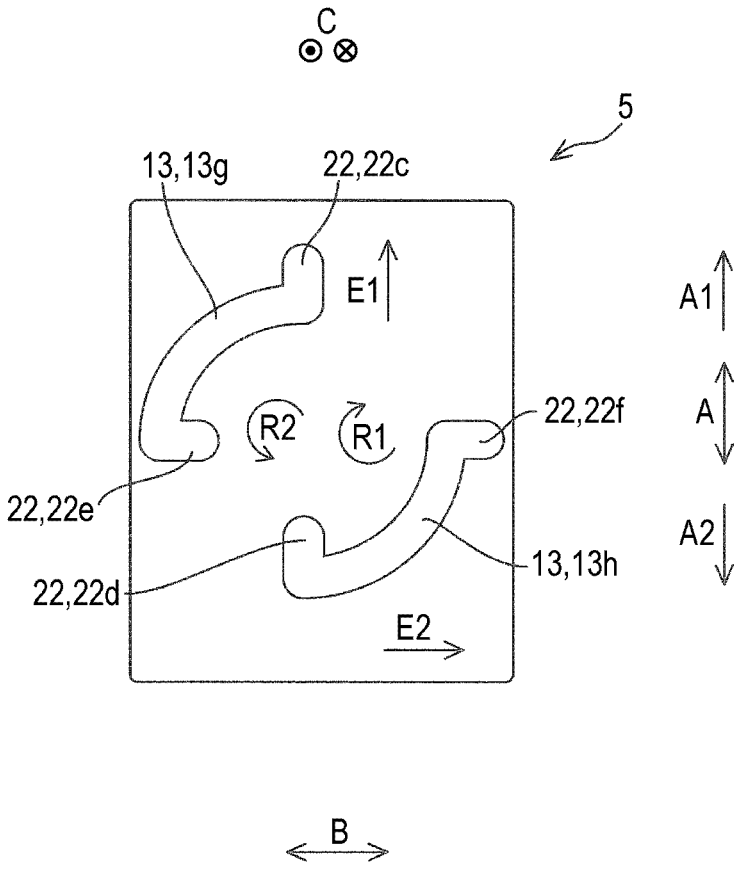
FIG. 10 is a schematic plan view illustrating a principal portion of a printing apparatus according to a third embodiment of the invention.

Third Embodiment (FIG. 10)

FIG. 10 illustrates a schematic plan view of a stage 5 as a principal portion of the printing apparatus 1 of the third embodiment, and corresponds to FIG. 7 of the printing apparatus 1 of the first embodiment and FIG. 9 of the printing apparatus 1 of the second embodiment.

Note that the printing apparatus 1 of the third embodiment has the same constitution as the printing apparatus 1 of the second embodiment except for the constitution of the fixing portion 22.

The fixing portions 22 of the printing apparatus 1 of the second embodiment are constituted of the projections 22*a* and 22*b* that are pushed in and pushed out with respect to the insertion opening 13.

Meanwhile, the fixing portions 22 of the third embodiment are constituted of retreat paths 22*c*, 22*d*, 22*e*, and 22*f* that are provided in insertion openings 13.

To be specific, as shown in FIG. 10, the retreat path 22*c* extending in a direction E1 along the movement direction A is formed at one side end portion of an arc-shaped hole portion 13*g* as the insertion opening 13, and the retreat path 22*e* extending in a direction E2 along the scanning direction B is formed at the other side end portion of the hole portion 13*g*. Further, the retreat path 22*d* extending in the direction E1 along the movement direction A is formed at one side end portion of an arc-shaped hole portion 13*h* as the insertion opening 13, and the retreat path 22*f* extending in the direction E2 along the scanning direction B is formed at the other side end portion of the hole portion 13*h*.

Then, when an operator applies a force to the tray 4 in the revolving direction R1, the tray 4 is revolved relative to the stage 5 so that the inserting portion 11*a* is positioned at the one side end portion of the hole portion 13*g* and the inserting portion 11*b* is positioned at the one side end portion of the hole portion 13*h*. Under this state, by moving the tray 4 in the direction E1 relative to the stage 5, the inserting portion 11*a* is fixed by the retreat path 22*c* and the inserting portion 11*b* is fixed by the retreat path 22*d*. That is, shifting of the tray 4 in the revolving directions R1 and R2 relative to the stage 5 is suppressed.

Meanwhile, when the operator applies a force to the tray 4 in the revolving direction R2, the tray 4 is revolved relative to the stage 5 so that the inserting portion 11*a* is positioned at the other side end portion of the hole portion 13*g* and the inserting portion 11*b* is positioned at the other side end portion of the hole portion 13*h*. Under this state, by moving the tray 4 in the direction E2 relative to the stage 5, the inserting portion 11*a* is fixed by the retreat path 22*e* and the inserting portion 11*b* is fixed by the retreat path 22*f*. That is, shifting of the tray 4 in the revolving directions R1 and R2 relative to the stage 5 is suppressed.

Print Range

In the above embodiments, a print range, that is, a range in which an image can be formed, by the print head 7, on the medium M supported by the tray 4 differs depending on whether the tray 4 is in the first state or the second state. To be specific, a print range of the first state is wider than a print range of the second state in the movement direction A, while the print range of the second state is wider than the print range of the first state in the scanning direction B. Accordingly, it is preferable that the printing apparatus 1 obtain information telling whether the tray 4 is in the first state or the second state (information on the orientation of the support unit), and perform printing based on the obtained information on the orientation of the support unit. The obtaining of the information on the orientation of the support unit in the printing apparatus 1 may be realized by providing a sensor for detecting the state of the tray 4 (orientation of the tray 4) in the printing apparatus 1, or realized by the user inputting the information via an interface or the like. With this, a situation where printing is performed on a portion outside the print range (printing is performed in a range where the medium M is not present) can be suppressed.

In the case where a print preview is displayed in a display device (a display unit or the like) connected to the printing apparatus 1, it is preferable that a print preview including the orientation information of the support unit be displayed. In this case, by adjusting the print position while looking at the print preview screen, the print position of the image can be favorably determined even if the state of the tray 4 is changed. In particular, in the third embodiment, it is effective to adjust the print position because the center position of the print range of the tray 4 varies between the first state and second state of the tray 4.

It is to be noted that the invention is not limited to the above embodiments, and various modifications can be made within the scope of the invention as defined in the aspects of the invention; and it goes without saying that such modifications are also encompassed in the scope of the invention.

This application claims priority under 35 U.S.C. § 119 to Japanese Patent Application No. 2016-024502, filed Feb. 12, 2016. The entire disclosure of Japanese Patent Application No. 2016-024502 is hereby incorporated herein by reference.

What is claimed is:

1. A printing apparatus comprising:

a support unit which has a support surface for supporting a medium and moves in a movement direction; and a print unit configured to perform printing on the medium supported by the support unit, wherein the support surface includes a first side and a second side that is shorter in length than the first side and extends in a direction intersecting with the first side, and the support unit can be displaced to be in a first state where the first side is so arranged as to be along the movement direction and a second state where the first side is so arranged as to be along a direction intersecting with the movement direction so that a face to which the print unit performs printing is the same between the first state and the second state.

2. The printing apparatus according to claim 1, further comprising:

a base unit capable of attaching/detaching the support unit;

a first engagement unit configured to engage the support unit and the base unit with each other when the support unit is set to the first state; and a second engagement unit configured to engage the support unit and the base unit with each other when the support unit is set to the second state.

3. The printing apparatus according to claim 1, further comprising:

a base unit capable of attaching/detaching the support unit, wherein the support unit can be displaced to be in the first state and the second state by being revolved relative to the base unit.

4. The printing apparatus according to claim 1, further comprising:

a fixing portion configured to fix the support unit in at least one of the first state and the second state.

5. A medium support method in a printing apparatus that includes a support unit which has a support surface for supporting a medium and moves in a movement direction and a print unit which performs printing on the medium supported by the support unit, where the support surface includes a first side and a second side which is shorter in length than the first side and extends in a direction intersecting with the first side, the method comprising:

displacing the support unit, in accordance with an outer shape of the medium, to be in a first state where the first side is so arranged as to be along the movement direction and a second state where the first side is so arranged as to be along a direction intersecting with the movement direction so that a face to which the print unit performs printing is the same between the first state and the second state.

* * * * *